US005755063A

United States Patent [19]

Ohnishi et al.

[11] Patent Number: 5,755,063

[45] Date of Patent: May 26, 1998

[54] UNIT BUILDINGS AND THEIR CONSTRUCTION PROCESS

[75] Inventors: Katsunori Ohnishi; Chika Iri; Yukari Murayama; Naoto Tanaka; Yasuhiro Yoden, all of Ibaraki, Japan

[73] Assignee: Sekisui Kagaku Kogyo Kabushiki Kaisha, Osaka, Japan

[21] Appl. No.: 598,967

[22] Filed: Feb. 9, 1996

[30] Foreign Application Priority Data

Feb. 10, 1995 [JP] Japan ..... 7-022635
Nov. 28, 1995 [JP] Japan ..... 7-309454

[51] Int. Cl.[6] ..... E04H 1/00

[52] U.S. Cl. ..... 52/79.8; 52/79.7; 52/79.9; 52/127.2

[58] Field of Search ..... 52/127.2, 79.1, 52/79.7, 79.8, 79.9

[56] References Cited

U.S. PATENT DOCUMENTS

| | | | |
|---|---|---|---|
| 3,503,170 | 3/1970 | Shelley | 52/79 |
| 3,526,067 | 9/1970 | Furter et al. | 52/127.2 X |
| 3,568,380 | 3/1971 | Stucky | 52/79 |
| 3,971,172 | 7/1976 | Gentil | 52/28 |
| 4,023,315 | 5/1977 | Stucky | 52/127.2 X |
| 4,136,492 | 1/1979 | Willingham | 52/79.7 |
| 4,364,206 | 12/1982 | Wybauw | 52/79.7 |
| 4,644,708 | 2/1987 | Baudot | 52/79.7 X |
| 4,644,709 | 2/1987 | Baumann | 52/127.2 X |
| 4,854,094 | 8/1989 | Clark | 52/79.7 X |

FOREIGN PATENT DOCUMENTS 185122 12/1992 Japan .

*Primary Examiner*—Carl D. Friedman
*Assistant Examiner*—Beth Aubrey
*Attorney, Agent, or Firm*—Dvorak & Orum

[57] ABSTRACT

A unit building 10, wherein a fixed corner portion of each of the four building modules 12 are disposed in such a way that they butt each other at the column-free butting portion 14, and a reinforcing beam 30 extending from between the ceiling beams 23, 23 of the two adjacent building modules 12 on a side of the column-free butting portion 14 to between the ceiling beams 23, 23 of the two adjacent building modules 12 on the other side of the column-free butting portion 14 is provided.

14 Claims, 11 Drawing Sheets

UNIT BUILDINGS AND THEIR CONSTRUCTION PROCESS

BACKGROUND OF THE INVENTION

1. Field of the Invention

This invention relates to unit building structures and their construction process. Particularly, the invention relates to a unit building formed by assembly of prefabricated modules.

2. Description of the Background Art

Generally, unit buildings are constructed by arranging side by side box-like building modules formed of columns, floor beams and ceiling beams. An ordinary building module necessarily consists of columns erected in each of four corners, and as a result, a plurality of columns are always erected in the center of the unit building constructed with a plurality of building modules the corners of which face each other. It is impossible to create a large continuous living room space fee of columns.

On the other hand, unit buildings for which columns may be omitted at the butting portions of building modules are described, for example, in Japanese Patent Application Laid Open No. Hei 4 (1992)-136341 or in Japanese Patent Application Laid Open No. Hei 6 (1994)-185122.

In the first laid-open prior art, a temporary column is erected in a fixed corner free of columns of each building module and after setting up the temporary columns of two building modules in such a way that they butt each other, those temporary columns are removed. On columns located on both sides of the butting portion of two building modules from which the temporary columns have been removed, reinforcing frames are extended below the ceiling beams to bridge these columns.

In the second laid-open prior art, in each of the corners with column omitted of four building modules a temporary column is erected, and the portions supported by the temporary columns of these four building modules are set-up in such a way that they butt each other. The four ceiling beams crossing at the butting portion unsupported by columns are connected by means of a reinforcing connector and then these temporary columns are removed.

The first laid-open prior art, however, has the following problems.

(1) It is only after removing temporary columns that any reinforcing frame can be fitted. Therefore, after the removal of the temporary columns until the complete fitting of reinforcing frames, the strength of building modules is extremely reduced, and ceiling beams may collapse from corners with column omitted from which temporary columns have been removed. In other words, workability and security is poor.

(2) Reinforcing frames extend beneath ceiling beams. Therefore, the reinforcing frames protrude beneath the ceiling beams, reducing the height of the ceiling beneath the beam.

The second laid-open prior art, on the other hand, has the following problems.

(1) At the butting portions of the four building modules the columns are omitted, and ceiling beams crossing each other at the butting portions free of columns are simply connected by means of reinforcing connectors. For this reasons, the strength of the ceiling structure of this unit building cannot be greater than the sum of sectional capacity of two connected ceiling beams of the adjacent building modules. Therefore, there is a limit to the expansion of ceiling span free of columns, and to the expansion of a wide continuous space free of columns.

SUMMARY OF THE INVENTION

The subject of this invention is to create a wide continuous space free of columns without reducing the height of the ceiling under the beams in the construction of a unit building and to maintain a sound structure.

According to the invention, a unit building is constructed with building modules made by assembling columns, floor beams and ceiling beams into a box shape being disposed adjacently, wherein at least one column-free corner portion of each of a plurality of building modules is disposed in such a way so as to butt each other at a column-free portion, and a reinforcing beam is extended in a gap between the adjacent modules, both ends of the said reinforcing beam are connected with each column of the building modules on both sides of the unit outward of the column-free portion, a central portion of the reinforcing beam being connected with the column-free portion of the building modules.

According to the invention, the unit building is constructed with the ceiling beams and floor beams crossing each other being connected with columns by means of joint pieces in three corner portions other than the column-free corner portion, and the ceiling beams and floor beams being connected with short columns by means of joint pieces in the column-free corner portion, and short columns being detachably connected with temporary columns, and both ends of the reinforcing beams being connected with the column via connection with the joint piece and the central portion of the reinforcing beam being connected with the short columns via connection with joint piece.

According to the invention, the unit building is constructed with a plurality of said building modules with a column-free corner portion serving as the lower floor on which a plurality of upper floor building modules are mounted, the height of the reinforcing beams extending to the floor beams of the upper floor building modules with the reinforcing beams being connected to the upper floor building modules too.

According to the invention, the upper floor reinforcing beams are fitted into a gap between ceiling beams of the adjacent upper floor building modules, the upper floor reinforcing beams being connected with each column with which the said ceiling beams of the upper building modules are connected.

According to the invention, a plurality of the upper floor building modules have column-free corner portions, and both ends of the upper floor reinforcing beams are connected respectively with the column of the building module on one side of the column-free butting portion and with the column of the building module on the other side of the column-free butting portion while the center of the reinforcing beams is connected with each of column-free portions of the building modules.

According to the invention, the unit building is constructed with a column-free corner portion for each of the four building modules disposed in such a way that they form a butt joint at the column-free portion, a reinforcing beam extending from between the ceiling beams of two adjacent building modules on one side of the column-free butting portion to between the ceiling beams of two adjacent building modules on the other side being fitted into a gap between adjacent modules, both ends of the reinforcing beams being connected respectively with each column of the two adjacent building modules on one side of the column-free butting portion and with each column of the two adjacent building modules on the other side thereof and the center of the reinforcing beam being connected with the column-free corner portion of the four building modules.

According to the invention, the unit building is constructed with a column-free corner portion of each of three building modules disposed in such a way that they butt each other at the column-free butting portion, a reinforcing beam extending from between the ceiling beams of two adjacent building modules on one side of the column-free butting portion to the ceiling beams of a building module on the other side fitted in a gap between adjacent modules, both ends of the reinforcing beam respectively connected with the column of the two adjacent building modules on one side of the column-free butting portion and with the column of the building module on the other side thereof and the center of the reinforcing beam connected with the column-free portion of the three building modules.

According to the invention, the unit building is constructed with a column-free corner portion of each of two building modules being connected in such a way that they butt each other at the column-free butting portion, another building module being disposed adjacently in such away that it extends to both sides of the column-free butting portion within a same surface including the column-free butting portion of the two building modules, a reinforcing beam extending from between the ceiling beams of two adjacent building modules on one side of the column-free butting portion to between the ceiling beams of two adjacent building modules on the other side being fitted into the gap between the adjacent modules, both ends of the reinforcing beam being respectively connected with each column of the two adjacent building modules on one side of the column-free butting portion and each column of the two adjacent building modules on the other side of the column-free butting portion, and the center of the reinforcing beam being connected with each column-free corner portion of the two building modules and the intermediate portion of the ceiling beam of a building module.

According to the invention, the unit building is constructed with a plurality of said building modules with a column-free corner portion serving as the lower floor on which a plurality of upper floor building modules are mounted, the height of the reinforcing beams extending to the floor beams of the upper floor building modules.

According to the invention, the building modules with column omitted are constructed with a detachable temporary column at the column-free corner portion, the temporary column is kept in service until the reinforcing beam of the building modules is fully connected, and that the temporary column is removed after the reinforcing beam has been completely connected.

According to the invention, the following functions and effects are obtainable.

In the unit building, both ends of the reinforcing beam are connected with the column of the building modules on a side of the column-free butting portion and with each of the columns of the building modules on the other side of the column-free butting portion. And the central portion of the reinforcing beam is connected with each of the column-free corner portions of a plurality of building modules. Therefore, the strength of the ceiling structure of this unit building will be the sum of the sectional capacity of the ceiling beam plus the sectional capacity of the reinforcing beam. Accordingly, it is possible to extend largely the ceiling span unsupported by columns and to create a large continuous space free of columns.

The reinforcing beam is fitted in such a way as to accompany the ceiling beam of the building module. Therefore, the reinforcing beam needs not protrude substantially below the ceiling beam and hence does not reduce the height of the ceiling under the beam.

The reinforcing beam is connected with columns and short columns by being connected with a joint piece designed to connect the ceiling beam with columns and short columns. Therefore, the set-up for connecting the reinforcing beam with columns and short columns can be simplified and made dependable and secure.

The reinforcing beam designed to enable the elimination of columns for the lower floor building modules is extended to the floor beam of the upper floor building modules. The extended portion is connected with the upper floor building modules. Therefore, the strength of the ceiling construction of the lower floor building modules without a column is eliminated is not only reinforced by the sectional capacity of the reinforcing beam itself but also by the strength of the floor beam construction of the upper floor building modules via the reinforcing beam. For this reason, it is possible to expand the ceiling span unsupported by columns of the lower floor building modules and to create a larger continuous space free of columns.

The upper floor reinforcing beam is fitted on the ceiling beam of the upper floor building modules at the same position as with the ceiling beam on which the reinforcing beam of the lower floor building modules is fitted, and the upper floor reinforcing beam is connected with each of the columns with which the ceiling beam of the upper floor building modules is connected. Therefore, the adjacent upper floor building modules are integrated by the upper floor reinforcing beam and the upper floor seems as if suspended by the column in the central portion of the upper floor building modules so that the load of the upper floor on the central portion of the lower floor building modules unsupported by column is reduced. For this reason, even if the connection (high-strength bolts, etc.) between the reinforcing beam of the lower building modules and the said lower building modules should break off resulting in a diminution of the strength of the ceiling construction at the column-free central portion of the lower floor building modules, the collapse of the floor of the upper floor building modules can be prevented.

If the sectional capacity of the reinforcing beam of the upper floor is enough to support the ceiling and floor of the upper floor building modules, it is possible to eliminate columns and to create a larger continuous space also in the upper floor building modules.

In a unit building constructed with a column-free corner portion for each of the four building modules being disposed in such a way that they butt each other at the column-free butting portion, it is possible to create a larger continuous space free of columns without reducing the height of the ceiling below its beam.

In a unit building constructed with a column-free corner portion for each of the three building modules being disposed in such a way that they butt each other at the column-free butting portion, it is possible to create a large continuous space free of columns without reducing the height of the ceiling below its beam.

In a unit building constructed with a column-free corner portion for each of the two building modules being disposed in such a way that they butt each other at the column-free butting portion, and with another building module being adjacently disposed in such a way that it extends to both sides of the column-free butting portion of the two building modules on the same surface including the column-free butting portion, it is possible to create a large continuous space free of columns without reducing the height of the ceiling below its beam.

The strength of the ceiling construction of the lower floor building modules from which some columns are eliminated is reinforced by the increase of the sectional capacity of the reinforcing beam itself. For this reason, it is possible to expand the ceiling span unsupported by columns of the lower floor building modules and to create a larger continuous space free of columns.

A temporary column erected at the column-free corner portion of building modules is not removed after the installation at site of the said building modules following the phases of their manufacture at a factory, transportation and storage unit a reinforcing beam is completely connected. Therefore, the strength of the building modules is not reduced while the work of connecting the reinforcing beams continues, and the strength of the building during the construction phase is sufficiently secured assuring a good workability.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENT

Figure 1A:
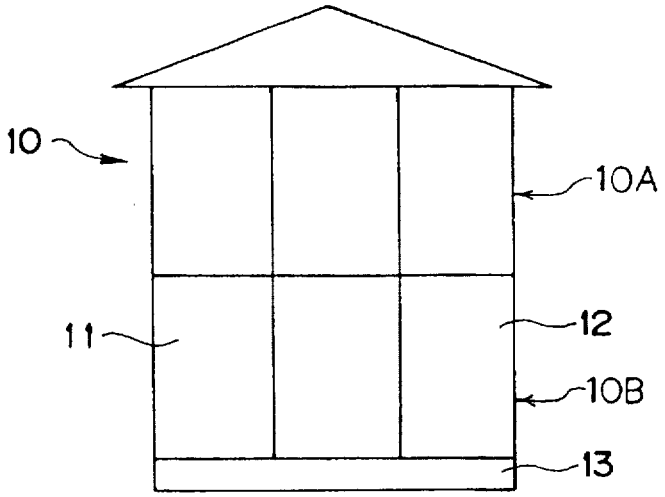
FIGS. 1A to 1C are perspective views of a unit building and building modules.

A unit building 10, as shown in FIG. 1A, is constructed with a plurality of standard building modules 11 and building modules 12 with column omitted manufactured at a factory being transported to construction site, being fixed adjacently in the horizontal and vertical directions on the foundation 13 laid out in advance forming thus the lower floor 10A and the upper floor 10B.

Figure 1B:
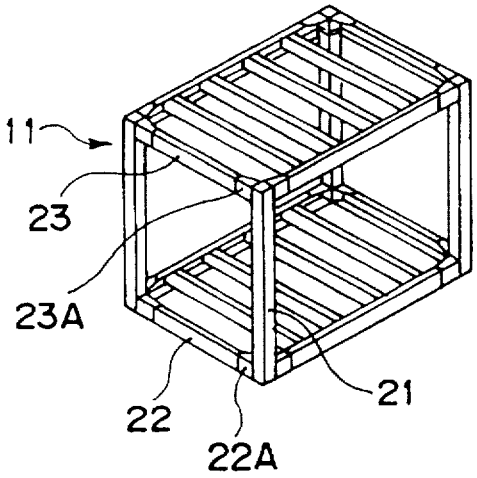

The standard building module 11, as shown in FIG. 1B, is a framework structure made by assembling in a box shape four square-shaped steel pipe columns 21, four square-shaped steel pipe floor beams 22 and four square-shaped steel pipe ceiling beams 23. The building module 11 is constructed with floor beams 22 crossing each other at the corner portion of the four building modules being connected with the bottom of columns 21 by a joint piece 22A, and ceiling beams 23 crossing each other being connected with the top of columns 21 by a joint piece 23A.

Figure 1C:
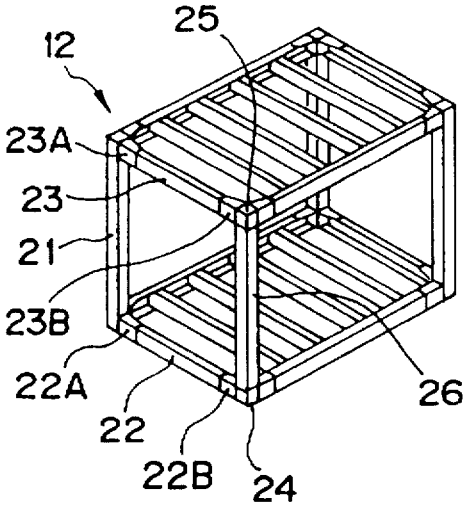

The building module 12 with column omitted is, as shown in FIG. 1C, corresponds to a standard building module 11 from which one of the four columns 21 is omitted. A building module 12 with column omitted is constructed, at three corners other than the corner unsupported by a column, with floor beams 22 crossing each other. The floor beams 22 are connected with the bottom of columns 21 by means of a joint piece 22A. Ceiling beams 23 cross each other and are connected with the top of columns 21 by means of a joint piece 23A, and at a corner portion with column omitted, with floor beams 22. The floor beams 22 cross each other and are connected with a short column 24 by means of a joint piece 22B and with ceiling beams 23. Ceiling beams 22 cross each other and are connected with a short column 25 by means of a joint piece 23B. In a building module 12 with a column omitted, at the corner portion with column omitted, a temporary column 26 is detachably connected. The temporary column 26 is connected with the short columns 24 and 25 by means of fastening means including bolts, pins, etc.

Figure 2:
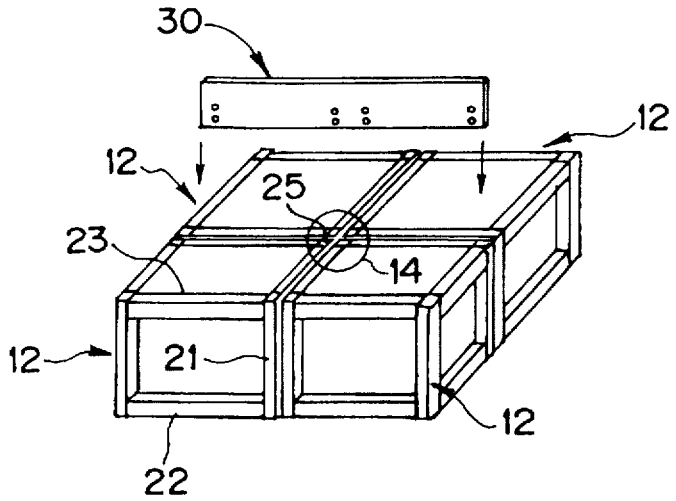
FIG. 2 is a perspective view showing the connecting process of a reinforcing beam to the lower floor building modules.

The unit building 10, however, is to be constructed such that the lower floor 10A, as shown in FIG. 2, has a corner portion wherein the column is omitted from each of the four building modules 12 and being disposed in such a way that they but each other at the column-free butting portion 14. These four building modules 12 with a column omitted may create a large continuous living room space free of columns 21. The following is a description of the connection construction of the four building modules 12 each omitting a column.

Figure 3A:
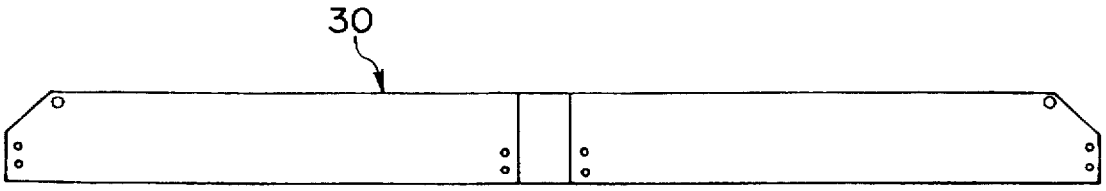
FIGS. 3A and 3B are perspective views showing the lower floor reinforcing beam.
Figure 3B:
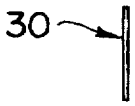
Figure 4:
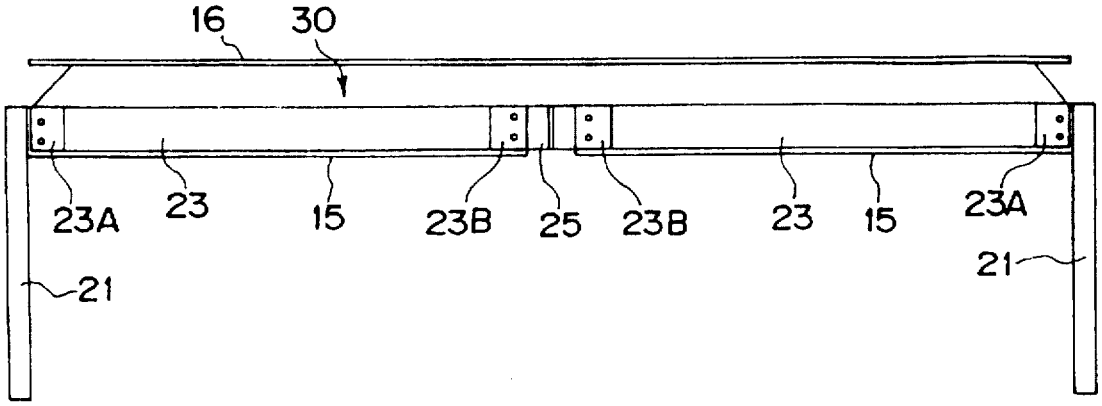
FIG. 4 is a perspective view showing the reinforcing construction of the lower floor.

In the lower floor 10A of the unit building 10, the column-free butting portion 14 of the four building modules 12 is reinforced by the lower floor reinforcing beam 30. The lower floor reinforcing beam 30, as shown in FIGS. 3A and 3B, consists of a long plate and as shown in FIGS. 2 and 4, extends between the ceiling beams 23 and 23 of two adjacent building modules 12 on one side of the right and left sides of the column-free butting portion 14 to between the ceiling beams 23 and 23 of the other adjacent two building modules on the other side thereof. In FIG. 4, element 15 represents the ceiling plate of the lower floor and 16 represents the floor plate of the upper floor.

Figure 5:
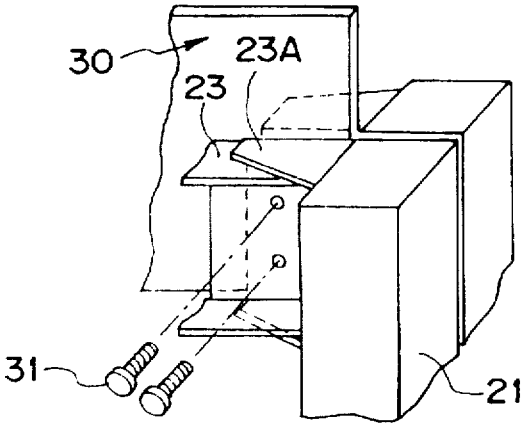
FIG. 5 is a perspective view showing the connecting construction at the ends of the lower floor reinforcing them.

Both ends of the lower floor reinforcing beam 30 arc, as shown in FIG. 5, connected with each column 21 of the two adjacent building modules 12 on one side of the right and left sides of the column-free butting portion 14 and with each column 21 of the two adjacent building modules 12 on the other side of the right and left sides of the column-free butting portion 14. At this time, both ends of the reinforcing beam 30 are connected with the column 21 through connection (friction grip bolt connection) with the ceiling beam 23 and joint pieces 23A by means of high-strength bolts 31.

Moreover, in practicing this invention, the above-mentioned connection of the reinforcing beam can be performed not only by high-strength bolts but also by ordinary bolts.

Figure 6:
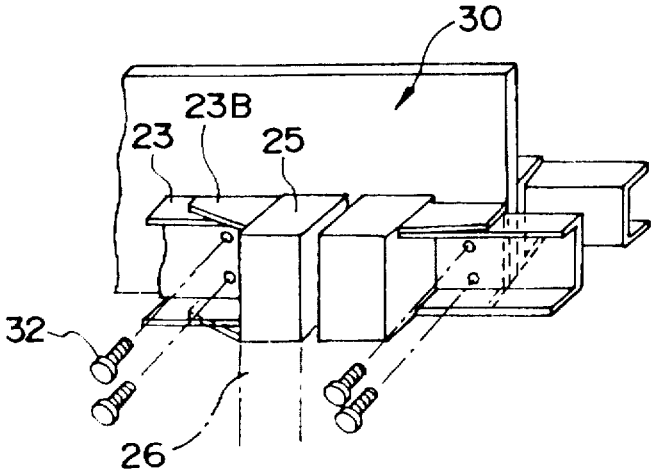
FIG. 6 is a perspective view showing the connecting construction at the central portion of the lower floor reinforcing beam.

The central portion of the reinforcing beam 30 is, as shown in FIG. 6, connected with each column-free corner portion of the four building modules 12. At this time, the central portion of the reinforcing beam 30 is connected with short columns 25 through connection with the ceiling beam 23 and joint pieces 23B by means of high-strength bolts 32.

When the reinforcing beam 30 is, as described above, connected with the column 21 and the short column 25, in the column-free corner portion of each building module 12, the short column 25 is still connected with a detachable temporary column 26. And when the reinforcing beam 30 is completely connected with the columns 21 and the short columns 25, the temporary column 26 is removed from the short column 25.

The reinforcing beam 30 may be connected by means of bolts even in portions where there are neither ceiling beams 23 and 23 in close contact with each other in the two adjacent building modules 12 and 12 nor with joint piece 23A and 23B.

Figure 7A:
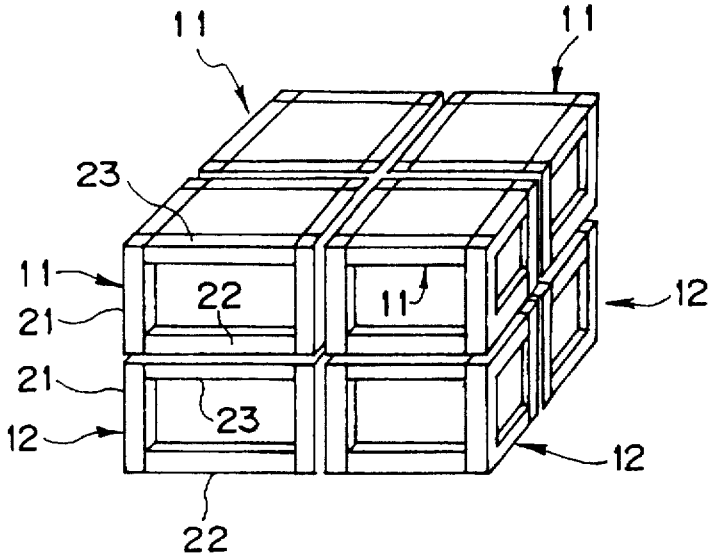
FIGS. 7A to 7C are perspective views showing the mounting construction of the upper floor building modules.
Figure 7B:
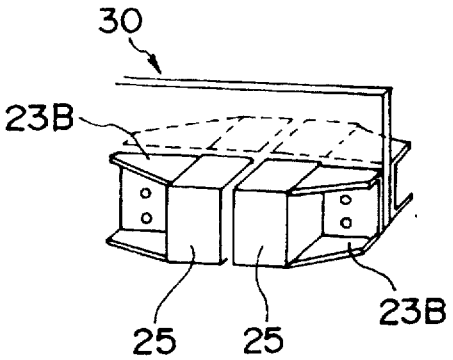
Figure 7C:
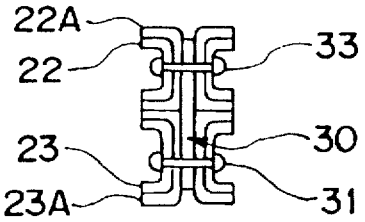

Mounting of the upper floor 10B to the lower floor 10A of the unit building is described in FIGS. 7A to 7C.

When the upper floor 10B is mounted on the lower floor 10A for the construction of the unit building 10, four standard building modules 11 for the upper floor may be mounted to the four building modules 12 having the omitted columns as part of the lower floor 10A (FIG. 7A). At this time, in the construction of the four building modules 11 for the upper floor, in the three corner portions of the lower floor with columns, the bottom of the three columns 21 of the building modules 11 for the upper floor are mounted on top of the three columns 21 of the building modules 12 of the lower floor. There will be connection between them, and in the column-free corner portion of the building modules 12 for the lower floor, the bottom of a column 21 of the building modules for the upper floor 11 is mounted on top of a short column 25 of the building modules 12 for the lower floor. There will be connection between them (FIG. 7B).

At this time, as shown in FIG. 7C, the height of the reinforcing beam 30 for the lower floor reinforcing the four building modules 12 is extended to between the adjacent floor beams 22 and 22 of the upper floor building modules 11 so that this extended portion of the reinforcing beam for the lower floor 30 may be connected with the floor beam 22 and joint pieces 22A of the upper floor building modules 11 by means of high-strength bolts 33.

Moreover, the height of the reinforcing beam 30 for the lower floor merely extends between the adjacent floor beams 22 and 22 of the upper floor building modules 11. The extended portion of the reinforcing beam 30 is merely held between the floor beam 22 and joint pieces 22A of the upper floor building modules 11 without using the high-strength bolt 33.

The reinforcement of the upper floor portion 10B above the lower floor portion will now be described in FIGS. 8 to 10C.

When the four standard building modules 11 for the upper floor are mounted on the four building modules 12 omitting a column for the lower floor as described above, and as shown in FIG. 8, a reinforcing beam for the upper floor 40 may be fitted between the ceiling beams 23 and 23 of the building modules 11 for the upper floor at an identical position between the ceiling beams 23 and 23 where the reinforcing beam 30 for the building modules 12 for the lower floor is fitted.

Figure 8:
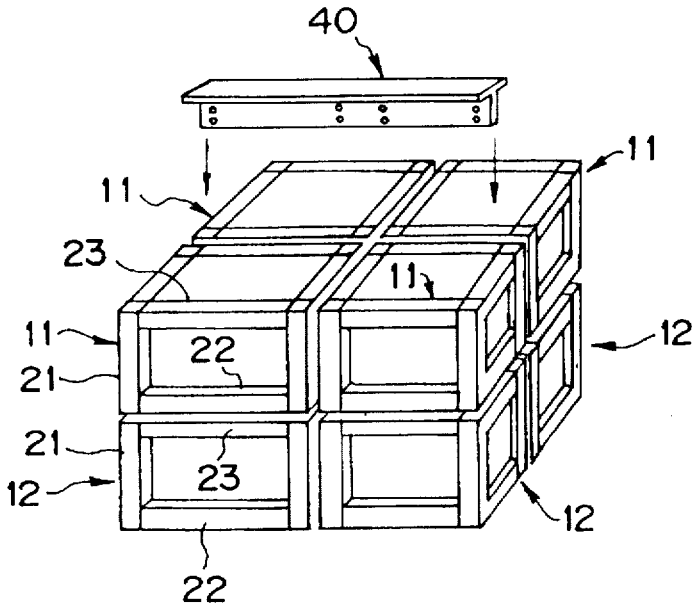
FIG. 8 is a perspective view showing the connecting process of a reinforcing beam to the upper floor building modules.
Figure 9A:
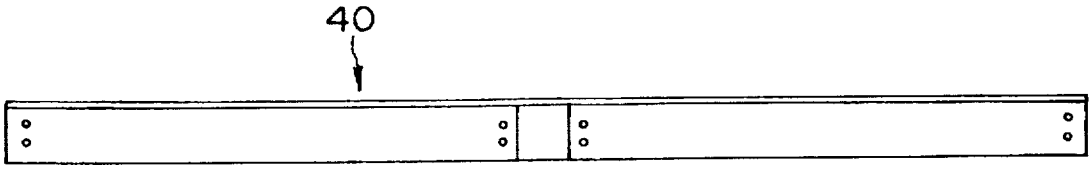
FIGS. 9A and 9B are perspective views showing the upper floor reinforcing beam.
Figure 9B:
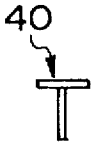
Figure 11:
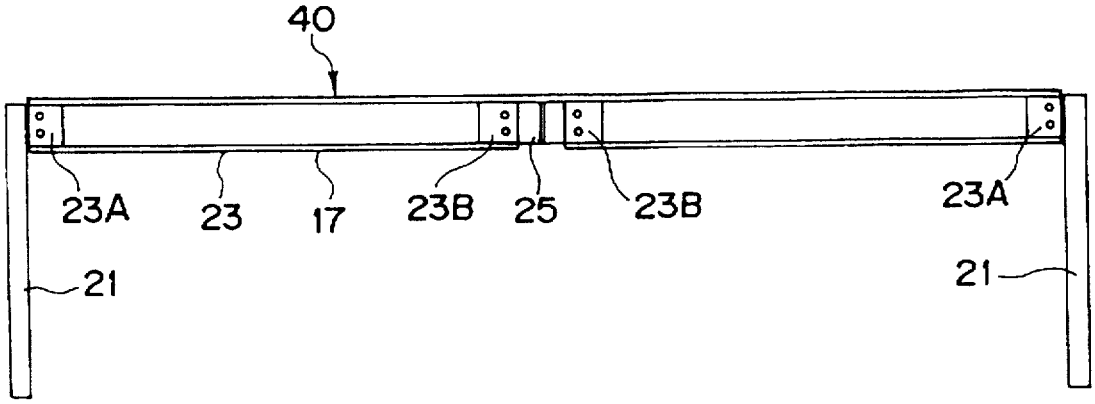
FIG. 11 is a perspective view showing the upper floor reinforcing construction.
Figure 12:
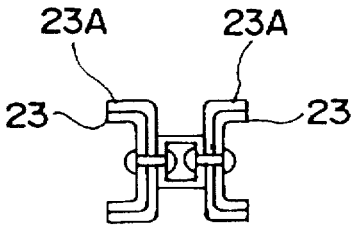
FIG. 12 is a perspective view showing a modification of reinforcing beam.

As shown in FIGS. 9A and 9B, the reinforcing beam for the upper floor 40, consists of a long T-shaped bar with a cross section in the form of T. As shown in FIGS. 8 and 11 it extends from between the ceiling beams 23 and 23 of the two adjacent building modules 11 on one side of the left and right sides to between the ceiling beams 23 and 23 of the two adjacent building modules 11 on the other side. In FIG. 11, element 17 shows the ceiling board for the upper floor.

Both ends and the central portion of the reinforcing beam for the upper floor 40 are, like both ends of the reinforcing beam for the lower floor 30 shown in FIG. 5, respectively connected with each column 21 of the two adjacent building modules 11 by means of high-strength bolts 41 through the ceiling beam 23 and joint pieces 23A.

The reinforcing beam for the upper floor 40 may be connected by means of bolts even in portions where there is neither ceiling beams 23, 23 in close contact each other of the adjacent two building modules 11, 11 nor joint piece 23A.

Figure 10A:
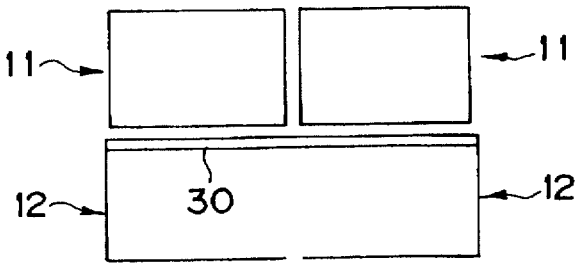
FIGS. 10A to 10C are perspective view showing the working of the upper floor reinforcing beam.
Figure 10B:
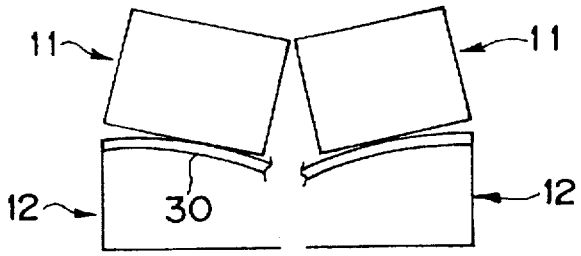
Figure 10C:
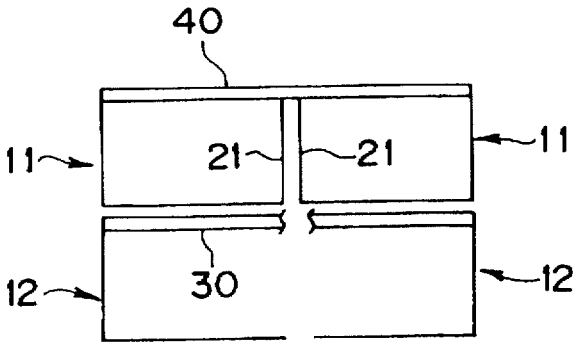

In this construction, the adjacent building modules 11 are integrated by the reinforcing beam for the upper floor 40, and the central column 21 of the four building modules 11 serves to suspend, so to speak, the floor of the upper floor (FIG. 10C), and reduces the load of the upper floor on the column-free central portion in the four building modules of the lower floor. In the absence of the reinforcing beam 40 for the upper floor 10B, when the connection between the reinforcing beam 30 for the lower floor building modules 12 and the columns 21 and the ceiling beams 23 for the lower floor building modules 12 are broken because of a rupture of high-strength bolts 31, 32 or other causes, the strength of the ceiling structure in the column-free central portion in the lower floor building modules 12 may be reduced causing the collapse of the floor of the upper floor building modules 11 as shown in FIG. 10B. The fitting of a reinforcing beam 40 for the upper floor 10B can prevent such collapse of the floor of the upper floor building modules 11.

The four upper floor building modules 12 mounted on the four building modules omitting a column for the lower floor may not be standard building modules 11 but may be building modules 12 with column omitted. In such a case, both ends of the upper floor reinforcing beam 40 are, as shown in FIG. 11, ceiling beams 23 and hence does not reduce the height of the ceiling under the beams.

(3) The reinforcing beam 30 is connected with columns 21 and short columns 25 via connections with joint pieces 23A and 23B designed for the purpose of connecting the ceiling beam 23 with those columns 21 and short columns 25. Therefore, the set-up for connecting the reinforcing beam 30 with the columns 21 and short columns 25 can be simplified and made dependable and secure.

(4) The reinforcing beam 30 designed for the purpose of eliminating a column for the lower floor building modules 12 is extended to between the adjacent floor beams 22 of the upper floor building modules 11. That extended portion is connected with the upper floor building modules 11. Therefore, not only the strength of the ceiling structure of the lower floor building modules 12 without a column is reinforced by the sectional capacity of the reinforcing beam 30 itself, but it is also reinforced through the reinforcing beam 30 by the strength of the floor beam construction of the upper floor building modules 11. For this reason, the ceiling span free of columns for the lower floor building modules 12 can be further expanded, and a larger continuous space free of columns can be created.

(5) A reinforcing beam for the upper floor 40 is fitted between the ceiling beams 23 of the upper floor building modules 11 at an identical position as between the ceiling beams 23 where the reinforcing beam 30 for the lower floor building modules 12 is fitted. The reinforcing beam for the upper floor 40 is connected with each column 21 with which the ceiling beams 23 of the upper floor building modules are connected. Therefore, the adjacent building modules 11 of the upper floor are integrated by the reinforcing beam for the upper floor 40. The central column 21 of the four building modules 12 of the upper serves to suspend the floor of the upper floor and reduces the load of the upper floor on the connected with each column 21 of the adjacent two building modules 12 for the upper floor on one side of the left and right sides and with each column 21 of the adjacent two building modules 12 on the other side of the left and right sides through connections with the ceiling beams 23 and joint pieces 23A by means of high-strength bolts 41. And the central portion of the upper floor reinforcing beam 40 is, in each column-free corner portion of the four building modules 12 for the upper floor, connected with short columns 25 through connections with the ceiling beams 23 and joint pieces 23B by means of high-strength bolts 42.

The reinforcing beam for the upper floor 40 may be connected with bolts even in portions where there are neither ceiling beams 23, 23 in close contact each other of the two adjacent building modules 12 and 12 across the reinforcing beam 40 nor joint pieces 23A, 23B.

The following is a description of the working of this embodiment.

(1) In a unit building 10, both ends of the reinforcing beam 30 are connected with each column 21 of the two adjacent building modules 12 on one side of the column-free butting portion and with each column 21 of the two adjacent building modules 12 on the other side of the butting portion, and the central portion of the reinforcing beam 30 is connected with each column-free corner portion of the four building modules 12. Therefore, the strength of the ceiling construction of this unit building 10 is the sum of the sectional capacity of the two ceiling beams in close contact with beams 23 and 23 of the adjacent building modules 12 plus the sectional capacity of the reinforcing beam 30. For this reason, the ceiling span free of column can be largely expanded and a large continuous space fee of columns can be created.

(2) The reinforcing beam 30 is sandwiched between the two ceiling beams 23 and 23 in close contact with each of the adjacent building modules 12. Therefore, the reinforcing beam 30 needs not protrude substantially below the ceiling beams 23 and hence does not reduce the height of the ceiling under the beams.

(3) The reinforcing beam 30 is connected with columns 21 and short columns 25 via connections with joint pieces 23A and 23B designed for the purpose of connecting the ceiling beam 23 with those columns 23 with those columns 21 and short columns 25. Therefore, the set-up for connecting the reinforcing beam 30 with the columns 21 and short columns 25 can be simplified and made dependable and secure.

(4) The reinforcing beam 30 designed for the purpose of eliminating a column for the lower floor building modules 12 is extended to between the adjacent floor beams 22 of the upper floor building modules 11. That extended portion is connected with the upper floor building modules 11. Therefore, not only the strength of the ceiling structure of the lower floor building modules 12 without a column is reinforced by the sectional capacity of the reinforcing beam 30 itself, but it is also reinforced through the reinforcing beam 30 by the strength of the floor beam construction of the upper floor building modules 11. For this reason, the ceiling span free of columns for the lower floor building modules 12 can be further expanded, and a larger continuous space free of columns can be created.

(5) A reinforcing beam for the upper floor 40 is fitted between the ceiling beams 23 of the upper floor building modules 11 at an identical position as between the ceiling beams 23 where the reinforcing beam 30 for the lower floor building modules 12 is fitted. The reinforcing beam for the upper floor 40 is connected with each column 21 with which the ceiling beams 23 of the upper floor building modules are connected. Therefore, the adjacent building modules 11 of the upper floor are integrated by the reinforcing beam for the upper floor 40. The central column 21 of the four building modules 12 of the upper floor serves to suspend the floor of the upper floor and reduces the load of the upper floor on the column-free central portion of the four building modules 12 of the lower floor. Therefore, even if the fasteners (high-strength bolts, etc.) between the reinforcing beam 30 for the lower floor building modules 12 and the lower floor building modules 12 are ruptured resulting in a reduced strength of the ceiling construction of the column-free central portion of the lower floor building modules 12, the collapse of the floor of the upper floor building modules 11 will be prevented.

(6) If the sectional capacity of the reinforcing beam for the upper floor 40 described in paragraph (5) above is sufficient to support the ceiling and floor of the upper floor building modules 12, it is possible to eliminate a column and thereby create a larger continuous space.

(7) A temporary column 26 erected in a column-free corner portion of the building modules 12 cannot be removed after fabrication at a factory of the building modules 12, their transportation, storage and erection at a site, until reinforcing beams 30 and 40 are fitted and are fully connected. Therefore, the strength of the building modules 12 is not reduced while connecting the reinforcing beams 30 and 40. A high quality security and workability is assured.

Figure 13A:
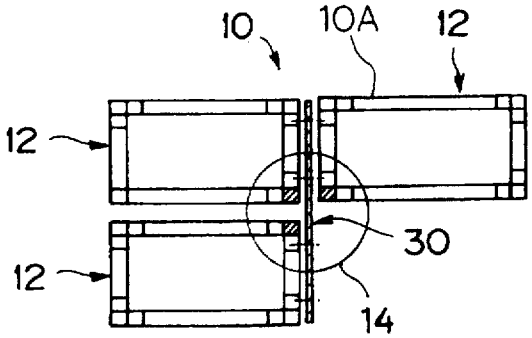
FIG. 13A and 13B are perspective views showing a unit building in the form of the second embodiment.
Figure 13B:
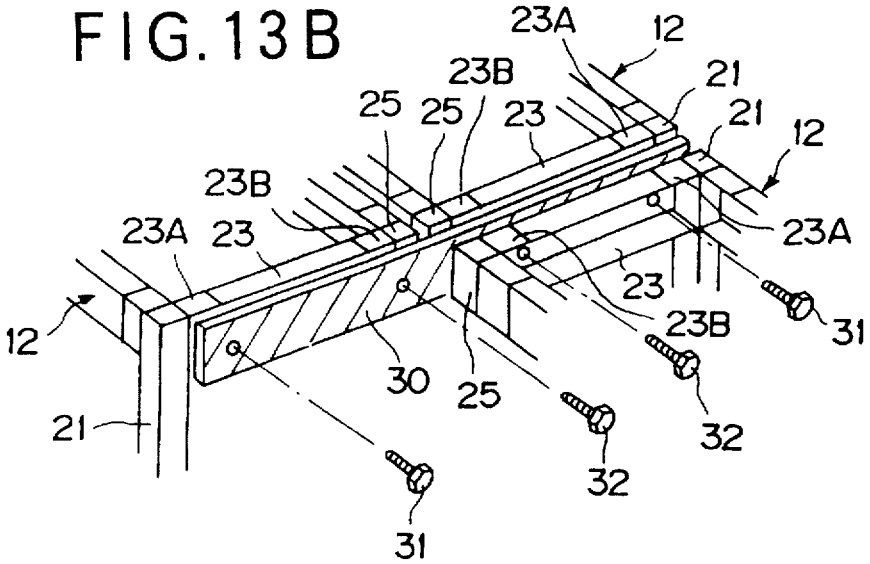

In the second embodiment, the unit building 10 is constructed in a part of the lower floor portion 10A, as shown in FIGS. 13A and 13B. The column-free corner portion of each of three building modules 12 are disposed to butt each other in a column-free butting portion 13 so that these four building modules with column omitted create a large continuous living room space free of any column 21. The following is a description of the butting construction of three column-free building modules 12.

In the lower floor portion 10A of the unit building 10, the column-free butting portion 14 of the three column-free building modules 12 is reinforced by the reinforcing beam for the lower floor 30. The reinforcing beam for the lower floor 30, as shown in FIGS. 13A and 13B, consists of a long plate, and extends from the ceiling beams 23, 23 of the two adjacent building modules 12 on one side (right side) of the column-free butting portion 14 to the ceiling beams 23 of the building modules 12 on the other side (left side).

As shown in FIGS. 13A and 13B, both ends of the lower floor reinforcing beams 30 are connected respectively with each respective column 21 of the two adjacent building modules on one side (right side) of the column-free butting portion 14 and with each column 21 of the building modules 12 on the other side (left side) of the column-free butting portion 14. At this time, both ends of the reinforcing beam 30 are connected with the columns 21 by means of high-strength bolts 31 (friction grip bolts) via the ceiling beams 23 and joint pieces 23A.

The central portion of the reinforcing beam 30 is connected with each column-free corner portion 14 of the three building modules 12. At this time, the central portion of the reinforcing beam 30 is connected with short columns 25 via connections with the ceiling beams 23 and joint pieces 23B by means of high-strength bolts 32.

When the reinforcing beam 30 is connected as described above with the columns 21 and short columns 25, the short column 25 in the column-free corner portion of each building module 12 is still connected with a detachable temporary column 26. And when the reinforcing beam 30 is completely connected with the columns 21 and short columns 25, the temporary column 26 is removed from the short column 25.

It should be noted in this regard that the reinforcing beam 30 may be connected by means of bolts even in portions where there is neither a ceiling beam 23 in close contact with the reinforcing beam 30 nor joint pieces 23A and 23B.

In the unit building 10 of the second of embodiment as in the first of embodiment, (a) the feature of extending the height of the lower floor reinforcing beam up to the floor beam of the upper floor portion 10B, (b) the feature of fitting a reinforcing beam for the upper floor on the ceiling beam of the upper floor portion 10B, and (c) the feature of eliminating a column for the upper floor portion 10B and reinforcing the column-free butting portion by the reinforcing beam for the upper floor may be adopted.

Figure 14A:
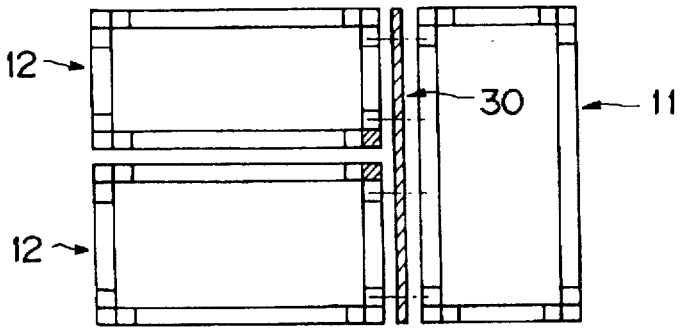
FIGS. 14A and 14B are perspective views showing a unit building in the form of the third embodiment.
Figure 14B:
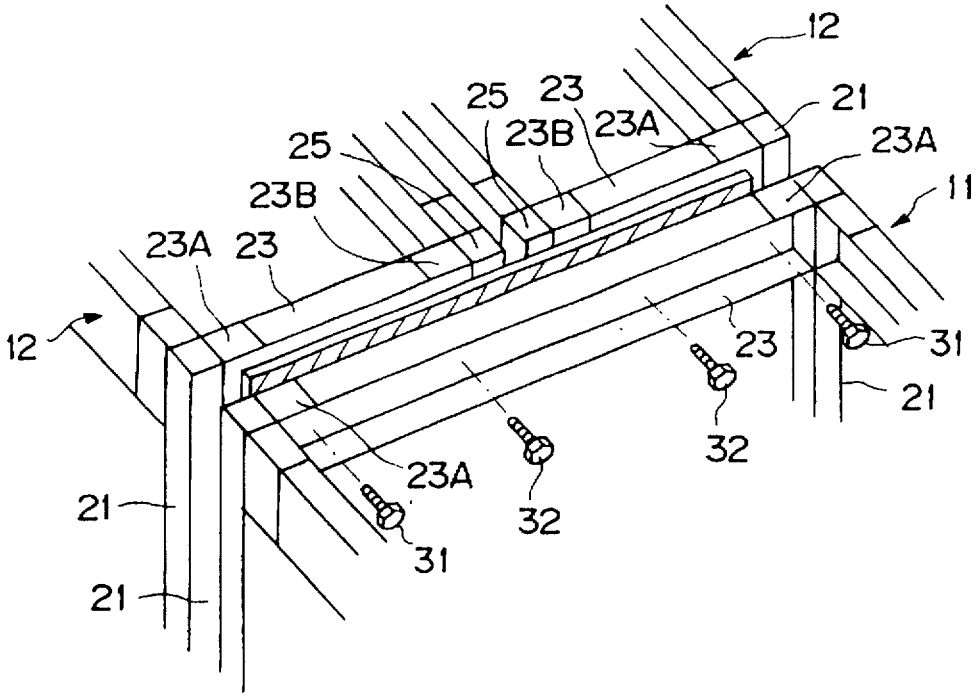

In the third form of embodiment, the unit building 10 is constructed, in a part of the lower floor portion 10A, as shown in FIGS. 14A and 14B. The column-free corner portion of two building modules 12 are disposed so that they butt each other, and another standard building module 11 being disposed adjacently so that it extends to both sides of the column-free butting portion 14 of the two column-free building modules 12 on the same surface including the column-free butting portion, and these two-column-free building modules 12 and a standard building module 11 create a large continuous living room space free of any column 21. The following is a description of the butting construction of the two building modules 12 omitting a column and a standard building module 11.

In the lower floor portion 10A of a unit building 10, the column-free butting portion 14 of two column-free building modules 12 is reinforced by the reinforcing beam 30 for the lower floor. As shown in FIGS. 14A and 14B, the reinforcing beam 30 for the lower floor consists of a long plate and extends from between the ceiling beams 23, 23 of the two adjacent building modules 12, 11 on one side of the column-free butting portion 14 to between the ceiling beams 23, 23 of the two adjacent building modules 12, 11 on the other side.

Both sides of the reinforcing beam 30 for the lower floor are, as shown in FIGS. 14A and 14B, connected with each column 21 of the two adjacent building modules 12, 11 on one side of the column-free butting portion 14 and with each column 21 of the two adjacent building modules 12, 11 on the other side of the column-free butting portion 14. At this time, both ends of the reinforcing beam 30 are connected with the columns 21 through high-strength bolt connections (friction grip bolt connection) with the ceiling beams 23 and joint pieces 23A by means of high-strength bolts 31.

The central portion of the reinforcing beam 30 is, as shown in FIG. 14A, connected with each column-free corner portion of the two building modules 12 and with the middle portion of the ceiling beam of a building module 11. At this time, the central portion of the reinforcing beam is connected with short columns 25 through connections with the ceiling beams 23 and joint pieces 23B by means of high-strength bolts 32.

When the reinforcing beam 30 is connected as described above with columns 21 and short columns 25, the column-free corner portion of each building module 12 is still connected detachably with a temporary column 26. And when the reinforcing beam 30 is connected completely with the columns 21 and short columns 25, the temporary column 26 is removed from the short column 25.

The reinforcing beam 30 may be connected by means of bolts, etc. even in portions where there is neither ceiling beam 23, 23 in close contact with other of the two adjacent building modules 12, 11 across the reinforcing beam 30, nor joint pieces 23A, 23B.

Figure 15A:
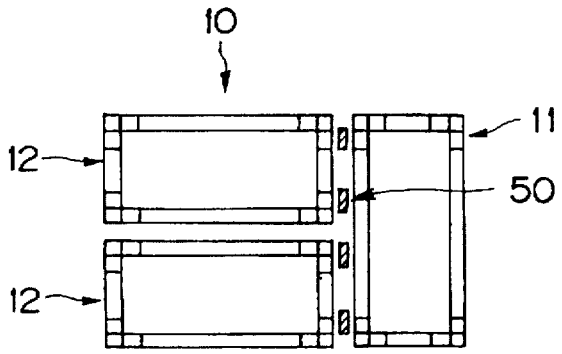
FIGS. 15A and 15B are perspective views showing a modified construction of unit building in the form of the third embodiment.
Figure 15B:
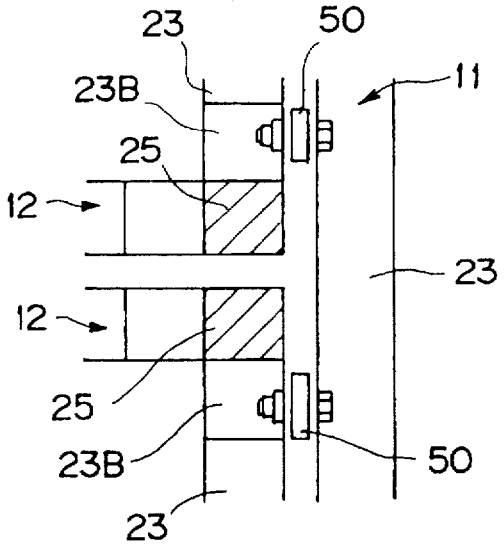

In a unit building 10 of the third form of embodiment wherein two column-free building modules 12 and a standard building module 11 form a large continuous living room space, in place of the building modules 11 form a large continuous living room space, in place of the butting construction of FIGS. 14A and 14B, the butting construction of 15A and 15B may be adopted. In FIGS. 15A and 15B, in place of the long reinforcing beam used in FIGS. 14A and 14B, reinforcing plates 50 are used. In other words, (a) a joint piece 23A integrated with each column 21 of the two adjacent building modules 12, 11 on one side (left or right) of the column-free butting portion 14 is connected by means of high-strength bolts via reinforcing plates 50, (b) a joint piece 23A integrated with each column 21 of the two adjacent building modules 12, 11 on the other side (left or right ) of the column-free butting portion 14 is connected by means of high-strength bolts via reinforcing plates 50, and (c) each corner portion of the two building modules 12 and the middle portion of the ceiling beam of a building module 11 are connected with high-strength bolts via reinforcing plates 50.

In a unit building 10 of the third embodiment form, as in the first embodiment form, (a) the step of extending the height of the reinforcing beam of the lower floor to the floor beam of the upper floor portion 10B, (b) the step of fitting a reinforcing beam for the upper floor on the ceiling beam of the upper floor portion 10B, and (c) the step of omitting a column for the upper floor portion 10B also, and reinforcing the column-free butting portion by the reinforcing beam for the upper floor, may be adopted.

Figure 16A:
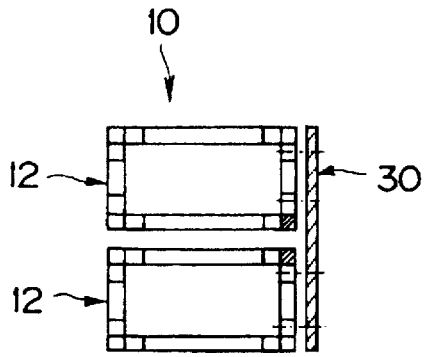
FIGS. 16A and 16B are perspective views showing a unit building in the form of the fourth embodiment.
Figure 16B:
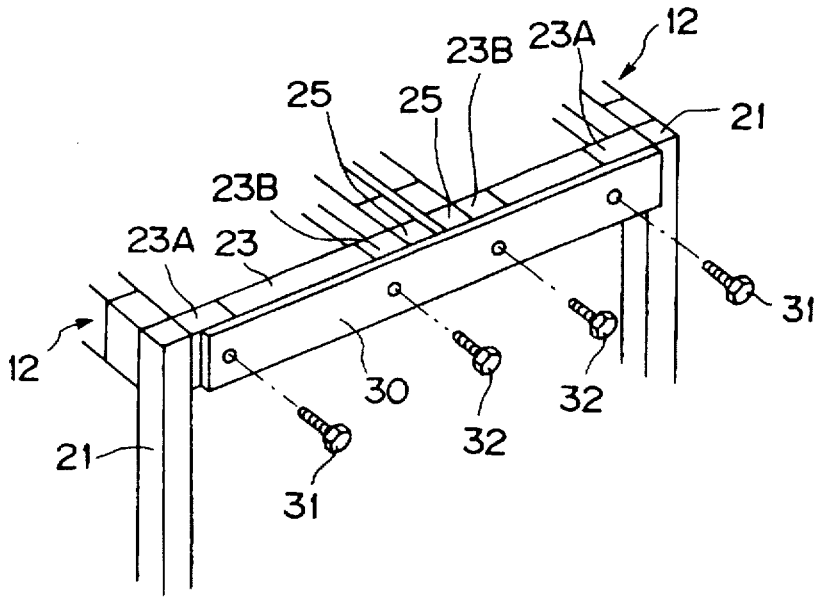

In the fourth embodiment form, a unit building 10 is constructed in a part of the lower floor portion 10A, as shown in FIGS. 16A and 16B. Each column-free corner portion of the two column-free building modules 12 is disposed so that they butt each other in column-free butting portion 14 so that these two column-free building modules 12 form a large continuous living room space free from any column 21. The following is a description of the butting construction of the two column-free building modules 12.

In the lower floor portion 10A of a unit building 10, the column-free butting portion 14 of the two column-free building modules 12 is reinforced by reinforcing beam 30 of the lower floor. The lower floor reinforcing beam 30, as shown in FIGS. 16A and 16B, consists of along plate and extends from the side of the ceiling beam 23 of the building modules 12 on one side (left or right) of the column-free butting portion 14 to the side of the ceiling beam 23 of the building modules 12 on the other side (left or right).

Both ends of the lower floor reinforcing beam 30 are, as shown in FIGS. 16A and 16B, connected respectively with the column 21 of the building modules 12 on one side (left or right) of the column-free butting portion 14 and the column 21 of the building modules 12 on the other side (left or right) of the column-free butting portion 14. At this time, both ends of the reinforcing beam 30 are connected with the columns 21 through high-strength bolt connections (friction grip bolt connection) with the ceiling beams 23 and joint pieces 23A by means of high strength bolts 31.

The central portion of the reinforcing beam 30 is, as shown in FIGS. 16A and 16B, connected with each column-free corner portion of the two building modules 12. At this time, the central portion of the reinforcing beam 30 is connected with short columns 25 through connection with the ceiling beam 23 and joint pieces 23B by means of high-strength bolts 32.

When the reinforcing beam 30 is connected as described above with the columns 21 and short columns 25, the short column 25 in the column-free corner portion of each building module 12 is still connected with a detachable temporary column 26. And when the reinforcing beam 30 is completely connected with the columns 21 and short columns 25, the temporary columns 26 are removed from the short column 25.

The reinforcing beam 30 may be connected with bolts even in portions where there is neither any ceiling beam 23 in close contact with the reinforcing beam 30 nor joint pieces 23A, 23B.

Furthermore, in a unit building 10 of the fourth embodiment form, as in the first embodiment form, (a) the step of extending the height of the lower floor reinforcing beam up to the floor beam of the upper floor portion 10B, (b) the step of fitting a reinforcing beam for the upper floor portion 10B, (b) the step of fitting a reinforcing beam for the upper floor on the ceiling beam of the upper floor portion 10B, and (c) the step of omitting a column also for the upper floor portion 10B and of reinforcing the column-free butting portion by the reinforcing beam for the upper floor, may be adopted.

Various embodiments of this invention have been described, however the specific embodiments of this invention are not limited to these modes, and any modifications in design to the extent that they do not deviate from the intent of this invention are included in this invention. For example, materials for reinforcing beams are not limited to steel plate and T bar beams, but they can also take the form of square-shaped, H shaped steel or C shaped steel beams. Furthermore, reinforcing bemas need not be connected by single passing of through bolts between the ceiling beams of the two adjacent building modules, but a surface of the reinforcing beam may be connected with a ceiling beam by means of a single bolt and another surface of the reinforcing beam may be connected with another ceiling beam by means of another bolt. In addition, reinforcing beams need not be bolted to ceiling beams, but welding and other fastening means may be used for attachment.

As described above, this invention permits the creation of large continuous space free of columns without reducing the height of the ceiling under the beam in the construction of a unit building.

While the present invention has been described in terms of several preferred embodiments, those of skill in the art will recognize that the present invention can be practiced with modifications without departing from the spirit and scope of the appended claims.

What is claimed is:

1. A unit building comprising:

a plurality of interconnected box-shaped building modules disposed in adjacent and stacked positions with respect to each other, said modules having a gap between each of said modules, each of said modules comprised of a floor portion and a ceiling portion interconnected together by a plurality of vertically arranged columns at respective corner locations of said box-shaped module, each of said floor portions comprised of a pair of horizontally-spaced side floor beams and a plurality of spaced, crossing floor beams arranged normally to and interconnected between said spaced side floor beams, each of said side floor beams having a corresponding first and second end, each of said crossing floor beams having corresponding first and second ends, and each of said vertical columns having corresponding top and bottom ends, wherein a first of said crossing floor beams connects said side floor beams at said respective first ends thereof and wherein a second of said crossing floor beams connects said side floor beams at said respective second ends thereof, said first crossing floor beam has said first end thereof jointly connected to said first end of said first side floor beam and to said bottom end of a first of said vertical columns, said second end of said first crossing floor beam thereof jointedly connected to said first end of said second side floor beam and to said bottom end of a second of said vertical columns, wherein said second crossing floor beam has said first end thereof jointedly connected to said second end of said first side floor beam and to said bottom end of a third of said vertical columns, said second end of said second crossing floor beam jointedly connected to said second end of said second side floor beam, each of said ceiling portions comprised of a pair of horizontally spaced side ceiling beams and a plurality of spaced, crossing ceiling beams arranged normally to and interconnected between said spaced side ceiling beams, each of said side ceiling beams having corresponding first and second ends, and each of said crossing ceiling beams having a corresponding first and second end, wherein a first of said crossing ceiling beams connects said side ceiling beams at said respective first ends thereof, and wherein a second of said crossing ceiling beams connects said side ceiling beams at said respective second ends thereof, said first crossing ceiling beam has said first end thereof jointedly connected to said first end of said first side ceiling beam and to said top end of said first vertical column, said second end of said first crossing ceiling beam jointedly connected to said first end of said second side ceiling beam and to said top end of said second vertical column, wherein said second crossing ceiling beam has said first end thereof jointedly connected to said second end of said first side ceiling beam and to said top end of said third vertical column, said second end of said second crossing ceiling beam jointedly connected to said second end of said second side ceiling beam, each of said jointed connections forming a respective module corner portion, a temporary column having upper and lower ends, the column insertable having the lower end adjacent the second end of the second crossing floor beam and the second end of the second side floor beam, and the upper end adjacent the second end of the crossing ceiling beam and the second end of the side ceiling beam;

a reinforcing beam extending from the side of the ceiling beam of the building modules on a side of the temporary column portion to the side of the ceiling beam of the building modules on the other side of the temporary column portion and being fitted in the gap between the adjacent modules, both ends of the reinforcing beam being connected respectively with each column of the building modules on a side of the temporary column portion and to each column of the building modules on the other side of the temporary column portion, and a central portion of the reinforcing beam connected with each temporary column corner portion of each of the building modules.

2. The unit building claimed in claim 1 wherein three building modules are disposed such that the temporary column corner portions of each module are in opposing relation to each other, wherein two modules are arranged in a front-to-back fashion with respect to each other to form a module set and the third module is arranged in an adjacent side-by-side fashion with one of said modules of said module set, the reinforcing beam extending between the respective ceiling beams of the two adjacent building modules and fitted in the gap between the modules, both ends of the reinforcing beam being connected respectively with the interconnecting columns of the two modules on a side common to the temporary column corner portions, a central portion of the reinforcing beam being connected with each of the short columns of the three building modules.

3. The unit building claimed in claim 1 wherein two building modules are disposed in a side-by-side relationship with respect to each other such that the short columns which form the corner portions of each module are in opposing relation to each other and wherein another building module having interconnecting columns at each of its corner portions is disposed to extend adjacent to and across both of the building modules on a side thereof which includes said temporary column corner portions, wherein the reinforcing beam is extended between the respective ceiling beams of the adjacent building modules and a side ceiling beam of the other building module, said reinforcing beam fitted in the gap between the adjacent modules, both ends of the reinforcing beam being connected respectively with each of the interconnecting columns of the two building modules on a side common to the temporary column corner portions, a central portion of the reinforcing beam being connected with each respective temporary column corner portions of the two modules and to an intermediate portion of the side ceiling beam of the other building module.

4. The unit building claimed in claim 1 wherein the temporary columns are left in position until all of the building modules are connected with the reinforcing beam, whereupon the temporary columns are removed.

5. A unit building comprising:

a plurality of interconnected box-shaped building modules disposed in adjacent and stacked positions with respect to each other, a first plurality of interconnected modules forming a lower floor of said unit building, and another plurality of interconnected modules forming an upper floor of said unit building, each of said modules, said respective upper and lower floors having a corresponding gap between each of said respective modules, each of said modules comprised of a floor portion and a ceiling portion interconnected together by a plurality of vertically arranged columns at respective corner locations of said box-shaped module, each of said floor portions comprised of a pair of horizontally spaced side floor beams and a plurality of spaced, crossing floor beams arranged normally to and interconnected between said spaced side floor beams, each of said side floor beams having a corresponding first and second end and each of said crossing floor beams having a corresponding first and second end, and each of said vertical columns having corresponding top and bottom ends, wherein a first of said crossing floor beams connects said side floor beams at said respective first ends thereof and wherein a second of said crossing floor beams connects said side floor beams at said respective second ends thereof, said first crossing floor beam having said first end thereof connected to a first crossing floor joint piece and said first end of said first side floor beam connected to a side first floor joint piece, each of said first joint pieces interconnected by said bottom end of a first of said vertical columns, said second end of said first crossing floor beam connected to a second crossing floor joint piece and said first end of said second side floor beam connected to a second crossing floor joint piece, each of said second joint pieces interconnected by said bottom end of a second of said vertical columns, wherein said second crossing floor beam having said first end thereof connected to a third crossing floor joint piece and said second end of said first side floor beam connected to a third crossing floor joint piece, each of said third joint pieces interconnected by said bottom end of a third of said vertical columns, said second end of said second crossing floor beam connected to a fourth crossing floor joint piece and said second end of said second side floor beam connected to a fourth side floor joint piece, each of said fourth floor joint pieces having a respective floor short column attached thereto, said floor short columns in abutting relationship to each other, a respective temporary column removably connected to each of said short columns, each of said ceiling portions comprised of a pair of horizontally spaced side ceiling beams and a plurality of spaced, crossing ceiling beams arranged normally to and interconnected between said spaced side ceiling beams, each of said side ceiling beams having a corresponding first and second end and each of said crossing ceiling beams having a corresponding first and second end, wherein a first of said crossing ceiling beams connects said side ceiling beams at said respective first ends thereof and wherein a second of said crossing ceiling beams connects said side ceiling beams at said respective second ends thereof, said first crossing ceiling beam having said first end thereof connected to a first crossing ceiling joint piece and said first end of said first side ceiling beam connected to a first side ceiling joint piece, each of said first ceiling joint pieces interconnected by said top end of said first vertical column, said second end of said first crossing ceiling beam connected to a second crossing ceiling joint piece and said first end of said second side ceiling beam connected to a second side ceiling joint piece, each of said second joint pieces interconnected by said top end of said second vertical column, wherein said second crossing ceiling beam having said first end thereof connected to a third crossing ceiling joint piece and said second end of said first side ceiling beam connected to a third side ceiling joint piece, each of said third ceiling joint pieces interconnected by said top end of said third vertical column, said second end of said second crossing ceiling beam connected to a fourth crossing ceiling joint piece and said second end of said second side ceiling beam connected to a fourth side ceiling joint piece, each of said fourth ceiling joint pieces having a respective ceiling short column attached thereto, said ceiling short columns in abutting relationship to each other, said respective temporary column removably connected to each of said short columns, each of said jointed floor and ceiling connections forming respective corner portions of said module, at least one pair of corresponding floor and ceiling corner portions of each module having a respective interconnecting column omitted from the module, at least two of said modules are aligned as a set in a front-to-back relationship with respect to each other, wherein said side floor beams and ceiling beams of said one module are in an aligned and coextensive relationship to said corresponding said side floor beams and ceiling beams of said other module, and wherein another two of said modules are aligned as another set in a front-to-back relationship with respect to each other, each of said sets arranged in a side-by-side relationship with respect to each other, said side floor beams and ceiling beams of said one front-to-back module set in an opposed relationship to said side floor beams and ceiling beams of said other front-to-back module set, wherein a corresponding floor and ceiling corner portion of each module within a module set has a respective interconnecting column omitted from the module, such that the column-free corner portions of each module are disposed in an abutting relation with each other such that said ceiling short column of each module is in abutting relation to each other;

a reinforcing beam having a vertical extent and delimited by a pair of ends with a central portion therebetween, said beam transversely extending between each of said front-to-back module sets and fitted into the gap between the adjacent modules only along said ceiling beams, wherein one end of the beam connected to each of the opposing interconnecting columns in the one front-to-back module set and the other end of the beam connected to each of the opposing interconnecting columns in the other front-to-back module set, said central portion connected to each of the column-free corner portions of said ceiling joint pieces which form said corner portions, a respective temporary interconnecting column removably connected to each of said short columns of said column-free corner portions.

6. The unit building claimed in claim 5 wherein said plurality of building modules forming the upper floor are superimposed and mounted on top of said modules forming said lower floor, wherein the reinforcing beam extends upwardly to the floor beams of the building modules forming the upper floor, the reinforcing beam also connected with the building modules of the upper floor.

7. The unit building claimed in claim 5 wherein, said plurality of building modules forming the upper floor are superimposed and mounted on top of said modules forming said lower floor, wherein the upper floor includes a second reinforcing beam having a pair of ends and a central portion, said reinforcing beam fitted in a gap between the respective ceiling beams of the adjacent building modules of the upper floor, the reinforcing beam for the upper floor connected with each of the interconnecting columns on a side common to the column-free corner portions, with which said ceiling beams of the building modules for the upper floor are connected.

8. The unit building claimed in claim 7 wherein said plurality of building modules comprising the upper floor each have a construction exacting to said modules forming said lower floor, each of said column-free corner portions of each upper floor module disposed in an abutting relation to each other, said upper floor including a reinforcing beam having a vertical extent and delimited by a pair of ends with a central portion therebetween, said upper floor reinforcing beam transversely extending between each of said front-to-back module sets and fitted into the gap between the adjacent modules, only along said ceiling beams, wherein one end of the beam is connected to each of the opposing interconnecting columns in the one front-to-back module set and the other end of the beam connected to each of the opposing interconnecting columns in the other front-to-back module set, said central portion of said upper beam connected to each of the short columns which form said column-free corner portions, a respective temporary interconnecting column removably connected to each of said short columns.

9. The unit building claimed in claim 5 wherein four building modules comprising the lower floor are disposed to butt each other at the column-free corner portions.

10. The unit building claimed in claim 5 wherein said plurality of building modules forming the upper floor are superimposed and mounted on top of said modules forming said lower floor, wherein the vertical height of the reinforcing beam extends upward to the floor beams of the building modules forming the top floor.

11. The unit building claimed in claim 10 wherein, the temporary columns are left in position until all of the building modules are connected with the reinforcing beam, whereupon the temporary column is removed.

12. The unit building claimed in claim 5 wherein the temporary columns are left in position until all of the building modules are connected with the reinforcing beam, whereupon the temporary columns are removed.

13. A unit building comprising:

a plurality of interconnected box-shaped building modules disposed in adjacent and stacked positions with respect to each other, a first plurality of interconnected modules forming a lower floor of said unit building, and another plurality of interconnected modules forming an upper floor of said unit building, each of said modules, said respective upper and lower floors having a corresponding gap between each of said respective modules, each of said modules comprised of a floor portion and a ceiling portion interconnected together by a plurality of vertically arranged columns at respective corner locations of said box-shaped module, each of said floor portions comprised of a pair of horizontally spaced side floor beams and a plurality of spaced, crossing floor beams arranged normally to and interconnected between said spaced side floor beams, each of said side floor beams having a corresponding first and second end and each of said crossing floor beams having a corresponding first and second end, and each of said vertical columns having corresponding top and bottom ends, wherein a first of said crossing floor beams connects said side floor beams at said respective first ends thereof and wherein a second of said crossing floor beams connects said side floor beams at said respective second ends thereof, said first crossing floor beam having said first end thereof and said first end of said first side floor beam interconnected by said bottom end of a first of said vertical columns, said second end of said first crossing floor beam and said first end of said second side floor beam interconnected by said bottom end of a second of said vertical columns, wherein said second crossing floor beam having said first end thereof and said second end of said first side floor beam interconnected by said bottom end of a third of said vertical columns, said second end of said second crossing floor beam and said second end of said second side floor beam interconnected by a floor short column, said floor short columns in abutting relationship to each other, a respective temporary column removably connected to each of said short columns, each of said ceiling portions comprised of a pair of horizontally spaced side ceiling beams and a plurality of spaced, crossing ceiling beams arranged normally to and interconnected between said spaced side ceiling beams, each of said side ceiling beams having a corresponding first and second end and each of said crossing ceiling beams having a corresponding first and second end, wherein a first of said crossing ceiling beams connects said side ceiling beams at said respective first ends thereof and wherein a second of said crossing ceiling beams connects said side ceiling beams at said respective second ends thereof, said first crossing ceiling beam having said first end thereof and said first end of said first side ceiling beam interconnected by said top end of said first vertical column, said second end of said first crossing ceiling beam and said first end of said second side ceiling beam interconnected by said top end of said second vertical column, wherein said second crossing ceiling beam having said first end thereof and said second end of said first side ceiling beam interconnected by said top end of said third vertical column, said second end of said second crossing ceiling beam and said second end of said second side ceiling beam interconnected by a ceiling short column, said ceiling short columns in abutting relationship to each other, said respective temporary column removably connected to each of said short columns, each of said jointed floor and ceiling connections forming respective corner portions of said module, at least one pair of corresponding floor and ceiling corner portions of each module having a respective interconnecting column omitted from the module, at least two of said modules are aligned as a set in a front-to-back relationship with respect to each other, wherein said side floor beams and ceiling beams of said one module are in an aligned and coextensive relationship to said corresponding said side floor beams and ceiling beams of said other module, and wherein another two of said modules are aligned as another set in a front-to-back relationship with respect to each other, each of said sets arranged in a side-by-side relationship with respect to each other, said side floor beams and ceiling beams of said one front-to-back module set in an opposed relationship to said side floor beams and ceiling beams of said other front-to-back module set, wherein a corresponding floor and ceiling corner portion of each module within a module set has a respective interconnecting column omitted from the module, such that the column-free corner portions of each module are disposed in an abutting relation with each other such that said ceiling short column of each module is in abutting relation to each other;

a reinforcing beam having a vertical extent and delimited by a pair of ends with a central portion therebetween, said beam transversely extending between each of said front-to-back module sets and fitted into the gap between the adjacent modules only along said ceiling beams, wherein one end of the beam connected to each of the opposing interconnecting columns in the one front-to-back module set and the other end of the beam connected to each of the opposing interconnecting columns in the other front-to-back module set, said central portion connected to each of the column-free corner portions of said ceiling joint pieces which form said corner portions, a respective temporary interconnecting column removably connected to each of said short columns of said column-free corner portions.

14. The unit building claimed in claim 13 wherein the temporary columns are left in position until all of the building modules are connected with the reinforcing beam, whereupon the temporary column is removed.

* * * * *